United States Patent [19]

Huisma

[11] Patent Number: 4,641,392

[45] Date of Patent: Feb. 10, 1987

[54] MULTIPURPOSE CLEANING AND TRANSPORTATION SYSTEM

[75] Inventor: Camiel Huisma, Airdrie, Canada

[73] Assignee: Oy Wärtsilä Ab, Helsinki, Finland

[21] Appl. No.: 762,721

[22] Filed: Aug. 5, 1985

[30] Foreign Application Priority Data

Aug. 8, 1984 [SE] Sweden ..... 8404014

[51] Int. Cl.[4] ..... A47L 5/38

[52] U.S. Cl. ..... 15/302; 15/314; 4/361; 4/661

[58] Field of Search ..... 15/301, 314, 302; 4/313, 316, 361, 362, 407, 408, 415, 661

[56] References Cited

U.S. PATENT DOCUMENTS

| | | | |
|---|---|---|---|
| 1,162,151 | 11/1915 | Fitts et al. | 15/314 |
| 1,621,596 | 3/1927 | Minuth | 15/314 |
| 3,173,164 | 3/1965 | Congdon | 15/314 |
| 3,239,849 | 3/1966 | Liljendahl | 4/661 X |
| 3,705,437 | 12/1972 | Rukavina et al. | 15/314 X |
| 4,034,421 | 7/1977 | Pihl et al. | 4/300 X |

FOREIGN PATENT DOCUMENTS

| | | | |
|---|---|---|---|
| 205060 | of 1907 | Fed. Rep. of Germany . | |
| 84370 | 7/1978 | Japan | 15/314 |

*Primary Examiner*—Chris K. Moore

*Attorney, Agent, or Firm*—Dellett, Smith-Hill and Bedell

[57] ABSTRACT

The invention relates to a multipurpose cleaning and transportation system. The system comprises a vacuum generating device and a liquid collecting container (10) which by a main pipe system (15) is connected to normally closed sockets (24). Dust cleaning tools (26, 27) can be connected to the sockets in order to create a passage from the tool to the main pipe system. The said pipe system is via a pipe (31) connected to a liquid absorbing hand tool (32) which is placed at a kitchen sink or the like for taking up liquid, crumbs and the like. It can also be connected to one or several liquid-supply units, for instance sanitary equipments (17).

11 Claims, 2 Drawing Figures

MULTIPURPOSE CLEANING AND TRANSPORTATION SYSTEM

Figure 1:
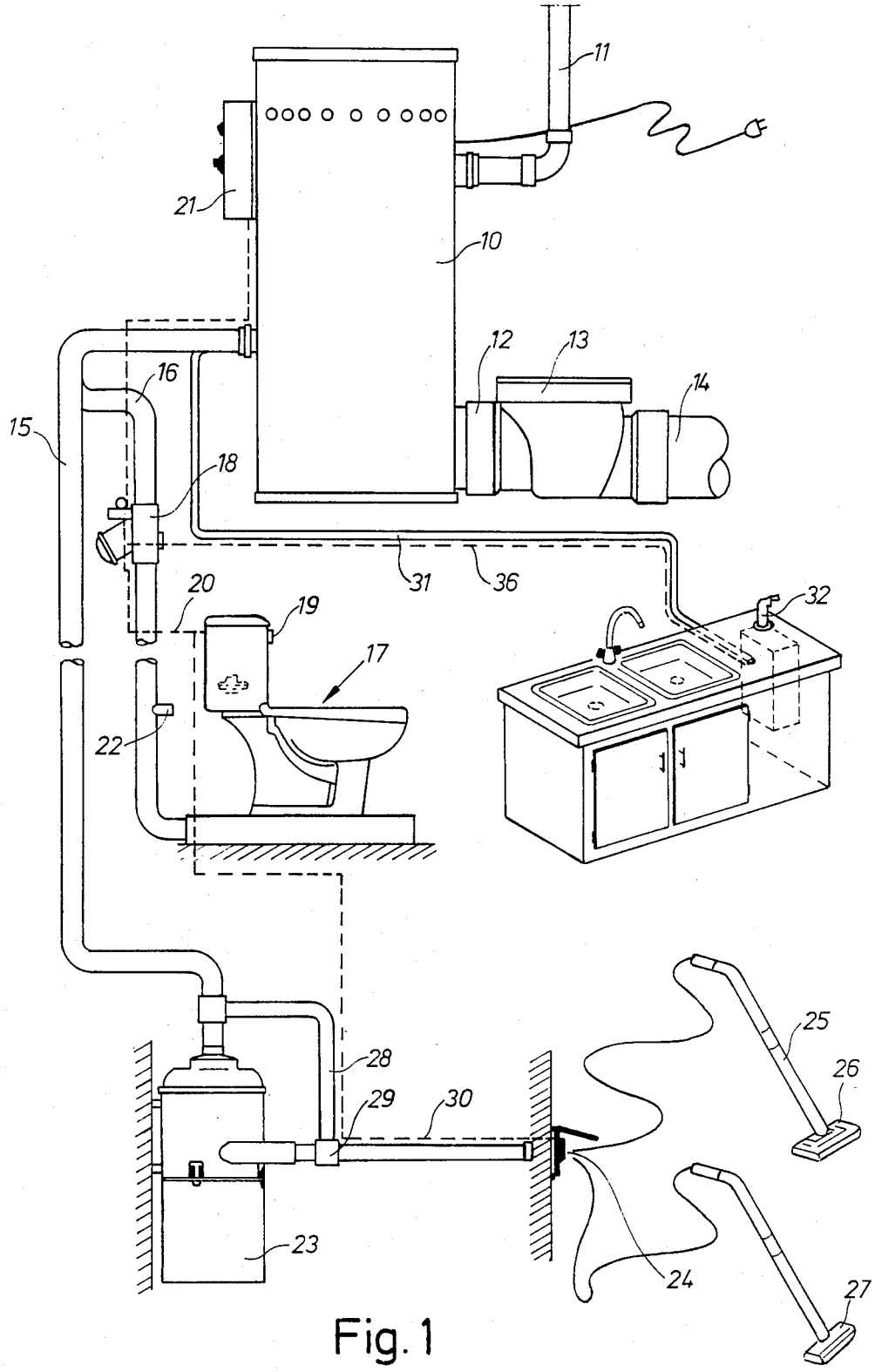

The invention relates to a multipurpose cleaning and transportation system.

It is previously known to use stationary installations in buildings for vacuum cleaning. Such installations comprise a fan which is placed centrally and via a pipe connected to several, normally closed, openings shaped as sockets in the walls of the building. In these sockets a vacuum cleaner hose with nozzle can be inserted for cleaning a floor surface. The dust entering the nozzle together with air will be transported to a filter in which the dust is separated from the air. This filter is placed at a suitable location in the flow path. The advantage of this system compared to traditional vacuum cleaning apparatus is of course that handling is facilitated since there will be no motor/fan unit, which is a rather bulky part of a vacuum cleaner, to carry during the cleaning.

It is also known to use vacuum in order to transport sewage in buildings. As a rule, such systems comprise a vacuum pump connected to a tank in which sub-atmospheric pressure is maintained. The tank is connected by means of a pipe system to sanitary installations which are separated from the pipe system by normally closed valves. On flushing, the valves are opened momentarily thereby allowing sewage and a given amount of air to enter the system. Due to the difference in pressure ahead of and behind the liquid plug formed, the sewage will be forced towards the tank, wherein the air is separated from the liquid, which is collected on the bottom of the tank. The sewage can then be transferred to a conventional sewage system, to a purification plant, or be treated in any suitable way.

The advantages of a system of the type referred to is that it is water saving and flexible since the sewage can be transported in all directions, i.e. also vertically upwards, and that in general the system can be built with smaller pipe dimensions than conventional plumbing systems.

Variations of the vacuum sewage system are also previously known. Thus, it is known to use other vacuum generating means than vacuum pumps, for instance ejectors and fans. It is also known instead of a collecting tank to use a smaller container working as a sluice in order to transfer the sewage to atmosphere after each flushing.

Traditional kitchen cleaning of surfaces and objects consists of diluting the dirt with a liquid (usually soap and water) and, thereafter, removing the contaminated solution. In the average household the contaminated solution is discharged through the sewer system.

In general, one of the following methods is used for applying the liquid.

(1) The sink is filled with water, soap is added, the liquid is stirred and transported to the object to be cleaned by absorbing it into a cloth, sponge or brush. To clean the object, the cloth or sponge is rubbed on the surface and, at the same time, squeezed to dispense the liquid.

(2) Undiluted soap is sprayed onto the object to be cleaned, water is added and mixed with the soap, and the dirt is diluted by rubbing.

(3) A premixed soap solution is sprayed onto the object to be cleaned and after rubbing the contaminated solution is removed, mainly by absorption into a sponge or cloth.

The effectiveness of the cleaning process is dependent upon the soap used (in general, the more effective the soap—the less environment friendly), the temperature of the water, and the amount of dilution. Thus, higher dilution means more labour and less requirement for aggressive soaps. Lower dilution means less labour but more aggressive soaps.

Using water of high temperature means that the solution has to be transported via a brush or container, as the human body cannot handle excessive water temperature.

It is also well known that more aggressive soaps are more expensive as well.

The main object of this invention is to provide a multipurpose system which can be used for vacuum cleaning as well as for the kind of kitchen cleaning referred to above by means of a particular tool. If desired, the system can also be used to transport sewage by means of vacuum.

Figure 2:
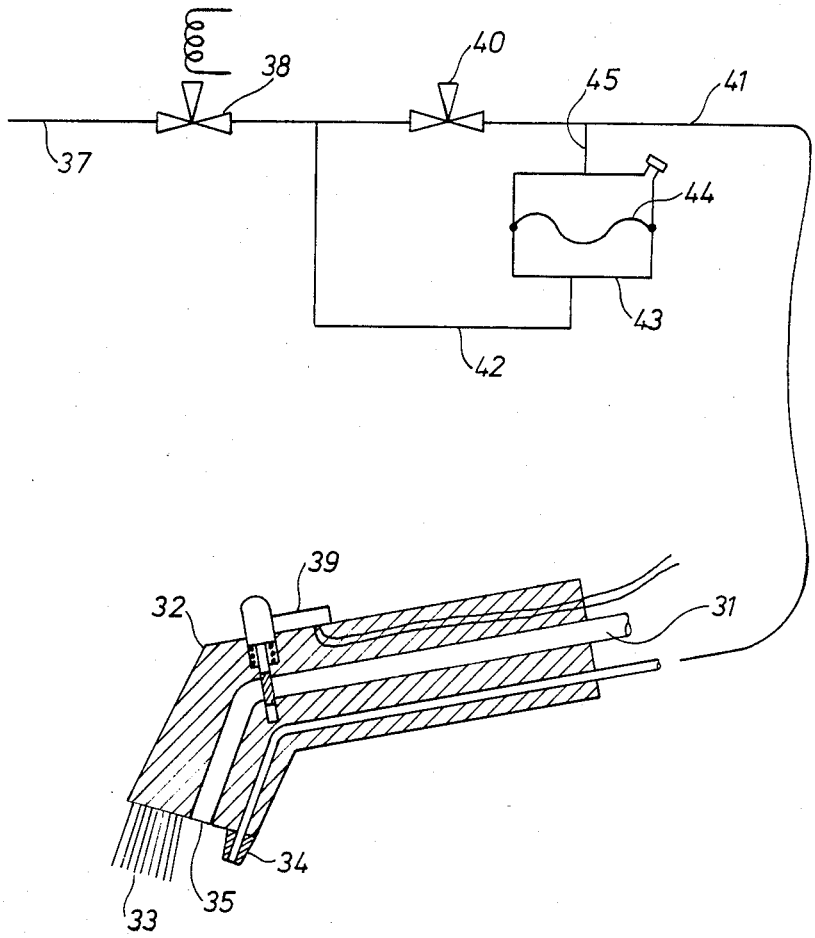

An embodiment of the invention will now be described with reference to the accompanying drawings in which FIG. 1 is a a schematic vertical section of a system according to the invention and FIG. 2 is a schematic vertical section of a detail in the system.

FIG. 1 shows a liquid/air separator 10 provided with a vacuum generating means, for instance a fan, not shown. Air flowing through the fan is let off to atmosphere through an evacuating pipe 11 whereas the liquid is collected in the lower part of the separator 10 from which it can flow through an outlet 12. The outlet 12 has a check valve 13 and is via a conduit 14 connected to a conventional sewage system, not shown. The separator 10 has an inlet which is connected to a main pipe system 15 which in turn can be connected to a secondary pipe system 16. To this secondary system one or several toilets 17 are connected by means of a valve 18. Also other types of sanitary equipment can be connected to the secondary pipe system. For this purpose the valves are preferably controlled by previously known so-called activators sensing the accumulation of sewage in a container and opening a valve between the vacuum system and the container.

Each toilet is in known manner provided with a known device, not shown, for supplying flushing water to the toilet bowl and with a flush button 19, preferably being an electric switch which by means of an electric wire 20 is connected to the valve 18 and a control unit 21, respectively. An opening with a check valve 22 can be provided on the pipe system 16 near the toilet in order to aerate the sewage, thereby increasing the lifting height. This opening is preferably situated at a height which is less than 1.5 m from the bottom of the toilet. When the flush button 19 is activated the vacuum generating device starts operating thereby closing the check valve 13, and then the valve 18 opens. Thus, sewage will be sucked into the pipe systems 16 and 15 and further towards the separator 10. The air leaves via the pipe 11 and the sewage is collected on the bottom of the separator. After a while the vacuum generating device stops operating so that the valve 18 closes and the valve 13 opens and sewage can leave through the pipe 14 to the sewage system.

The main pipe system 15 is provided with dust separating means 23 and branches off to several sockets 24 which are normally closed to atmosphere. The dust separating means 23 comprises for instance a cyclone filter, in which dust-laden air can be cleaned. To the socket a vacuum cleaning tool in the form of a hose with a handle 25 and nozzle 26 can be connected. In said socket or in a separate socket it is also possible to insert a wet floor cleaning tool 27, i.e. a tool which removes cleaning liquid or the like which has been applied earlier. To prevent the liquid from reaching the dust separation means 23 there is a bypass-conduit 28 which by means of a valve 29 connects the main pipe system 15 directly to the socket 23 when a wet cleaning tool is connected to the system. This is achieved automatically by means of conventional control equipment in the control unit 21 and electric transmitting means 30.

To the main pipe system 15 also a branch pipe 31 is connected. This pipe extends to an allround tool 32 placed at a kitchen sink. This tool comprises a brush 33 and a manually operated spray nozzle 34 and also a manually operated contaminated water suction intake 35 by means of which connection can be established between the branch pipe 31 and the tool 32 at the same time as the vacuum generating device is started by an electric signal which is transmitted through a conduit 36 included in the system in order to remove liquid from the sink or from some other place through the suction intake. The control unit comprises the electric equipment necessary for controlling the function of the system.

When using the allround tool 32 soap and water are automatically mixed. This is shown in FIG. 2, in which 37 is a hot water pipe which is provided with a solenoid valve 38. When a button 39 at the allround tool 32 is depressed, the solenoid valve 38 will allow the water to pass through. By setting a valve 40 in a connection pipe 41 between the hot water pipe 37 and the tool 32 the dilution ratio can be adjusted. A pipe 42 is provided between the hot water pipe 37 and a container 43. The container 43 has a diaphragm 44 separating the soap from the water. The wter pressure behind the diaphragm 44 will force the soap through an outlet 45 out of the container into the pipe 41 during spraying. Thus, it is possible to maintain as high a water temperature as the hot water system of a house will allow.

What is claimed is:

1. A building having a container for collecting liquid, a main pipe system connected to the container and having branches that terminate at several locations through the building, pump means for exhausting air from the main pipe system, and closure devices at the terminations of said branches, whereby the pump means establish a partial vacuum in the main pipe system, a first of the closure devices being a normally-closed socket for detachably receiving a dust cleaning tool so that air is drawn into the main pipe system by way of the dust cleaning tool and said socket and a second of the closure devices being a normally-closed valve, and wherein the building also has a sewage-producing unit connected to the main pipe system by way of the normally-closed valve.

2. A building according to claim 1, also having dust separating means connected to the main pipe system between the first closure device and said container.

3. A building according to claim 2, comprising a bypass conduit connected between the first closure device and the main pipe system, so that fluid can pass from the first closure device to the container without passing through the dust separating means.

4. A building according to claim 1, comprising a liquid-collecting hand tool which defines a duct that is connected to the main pipe system and incorporates a third closure device.

5. A building according to claim 4, wherein the hand tool defines a second duct that terminates in a nozzle by means of which liquid can be sprayed over a surface to be cleaned.

6. A building according to claim 5, wherein the second duct is connected to a pipe for supplying water under pressure to said nozzle, and wherein the building also comprises a dispenser for dispensing liquid soap into the water pipe, said dispenser defining first and second chambers separated by a flexible diaphragm, a flow control valve connected in the water pipe, and first and second conduits connecting the first and second chambers to the water pipe at locations upstream and downstream respectively of the flow control valve.

7. A building according to claim 6, comprising a solenoid valve connected in the water pipe for controlling flow of water to the hand tool, and switch means carried by the hand tool for controlling operation of the solenoid valve.

8. A building according to claim 4, wherein the hand tool comprises a brush.

9. A building according to claim 1, wherein the pump means are integrated within the liquid collecting container.

10. A building according to claim 1, wherein the sewage producing unit comprises a liquid collector, and a secondary pipe system is connected between the main pipe system and the liquid collector, said secondary pipe system having a vertical section situated close to the liquid collector and provided with an opening to atmosphere.

11. A building according to claim 10, wherein the opening is provided with a check valve allowing air to enter the secondary pipe system but preventing escape of liquid from the secondary pipe system.

* * * * *